US006019223A

United States Patent [19]

Harftst

[11] Patent Number: 6,019,223

[45] Date of Patent: Feb. 1, 2000

[54] CARRYING CASE

[75] Inventor: Karl Hermann Harftst, Langgons-Dornholzhausen, Germany

[73] Assignee: Consel Kofferlosungen GmbH, Germany

[21] Appl. No.: 09/219,260

[22] Filed: Dec. 22, 1998

[30] Foreign Application Priority Data

Dec. 23, 1997 [DE] Germany ..... 297 22 718 U

[51] Int. Cl.[7] ..... B65D 81/02

[52] U.S. Cl. ..... 206/523; 206/586; 206/320; 220/845; 220/848

[58] Field of Search ..... 206/305, 320, 206/523, 591, 586, 576; 220/845, 848, 810, 632; 16/267; 190/124

[56] References Cited

U.S. PATENT DOCUMENTS 2,732,581 1/1956 Heck ..... 16/267
4,287,990 9/1981 Kurick ..... 206/448
4,845,809 7/1989 Pillifant, Jr. ..... 16/267
5,002,184 3/1991 Lloyd ..... 206/305
5,311,643 5/1994 Marquardt et al. ..... 16/267

*Primary Examiner*—Paul T. Sewell
*Assistant Examiner*—Nhan T. Lam
*Attorney, Agent, or Firm*—Reising, Ethington, Barnes, Kisselle, Learman & McCulloch, PC

[57] ABSTRACT

A carrying case, for example for an item of equipment such as a notebook, comprises a bottom portion and a top portion which can be closed to enclose the item of equipment. The top and bottom portions of the case are hingedly connected together by hinges each comprising a first hinge body and a second hinge body secured adjacent to each other to narrow sides of the top and bottom portions of the case. The hinge bodies are hingedly connected together and are in the form of shock-absorbing feet, including shock-absorbing portions which can be compressed when the case is put down.

6 Claims, 1 Drawing Sheet

CARRYING CASE

FIELD OF THE INVENTION

The invention relates to a carrying case, for example for carrying a notebook.

BACKGROUND OF THE INVENTION

A typical carrying case for a notebook includes a case bottom portion in which the notebook and possibly a printer can be accommodated, and a case top portion for enclosing those items of equipment. When such cases are being carried around, situations often arise in which the case is set down on a surface such as a desk or the floor, and for that reason a narrow side of the case, which is disposed opposite to the handle for carrying the case, is provided with feet or legs on which the case rests when it is put down. When a case is put down, that may usually happen with a fairly abrupt movement resulting in a bump or jolt when the case meets the surface on which it is being placed, and that bump or jolt can be propagated into the interior of the case and thereby transmitted to the item of equipment such as the notebook which is to be protected in the case.

SUMMARY OF THE INVENTION

An object of the present invention is to provide a carrying case, for example for a notebook, which is such as to provide more effective, protection for an article accommodated in the carrying case.

Another object of the present invention is to provide a carrying case, for example for a notebook, which is capable of reducing the shock applied to an item of equipment within the case when the case is put down.

In accordance with the principles of the present invention the foregoing and other objects are attained by a carrying case, for example for a notebook, comprising a case bottom portion for receiving an item of equipment to be protected, such as the notebook, and a case top portion for enclosing the item of equipment. The case further includes hinge means for pivotably connecting the case bottom portion and the case top portion together. The hinge means include a first hinge body and a second hinge body which are fixed to the case bottom portion and the case top portion respectively in mutually adjacent relationship at the narrow sides thereof, and hinge connections adapted to couple the respective first and second hinge bodies together. The hinge bodies are in the form of shock-absorbing feet or legs of the case and include shock-absorbing portions which are adapted to be compressed when the case is put down.

As will be apparent from a description set our hereinafter of a preferred embodiment of the invention, by virtue of the above-indicated yielding nature or compliance imparted to the carrying case by reason of the shock-absorbing feet with the compressible shock-absorbing portions operatively associated therewith, deceleration to which the carrying case is subjected, for example when the case is put down, is attributed to the spring travel or yielding resilience of the shock-absorbing portions so that such deceleration does not assume the high values which are to be expected in relation to a relatively rigid structure, as a carrying case otherwise constitutes.

The shock-absorbing portions may be in the form of sponge or foam rubber layers which are for example approximately 10 mm in thickness and which can be compressed to about 5 mm when an impact force or a compression force is applied thereto. The difference between the uncompressed thickness of about 10 mm and the compressed thickness of about 5 mm constitutes an additional braking or deceleration travel of 5 mm which, in conjunction with internal cushioning in the interior of the carrying case, will generally be sufficient to protect sensitive items of equipment such as notebooks from excessive jolting or like effects.

In a preferred feature of the invention, the shock-absorbing portions may be disposed in the form of on intermediate layer between the associated portion of the case, and the respective hinge bodies.

Further objects, features and advantages of the invention will be apparent from the following description of a preferred embodiment.

DESCRIPTION OF THE PREFERRED EMBODIMENT

Figure 1:
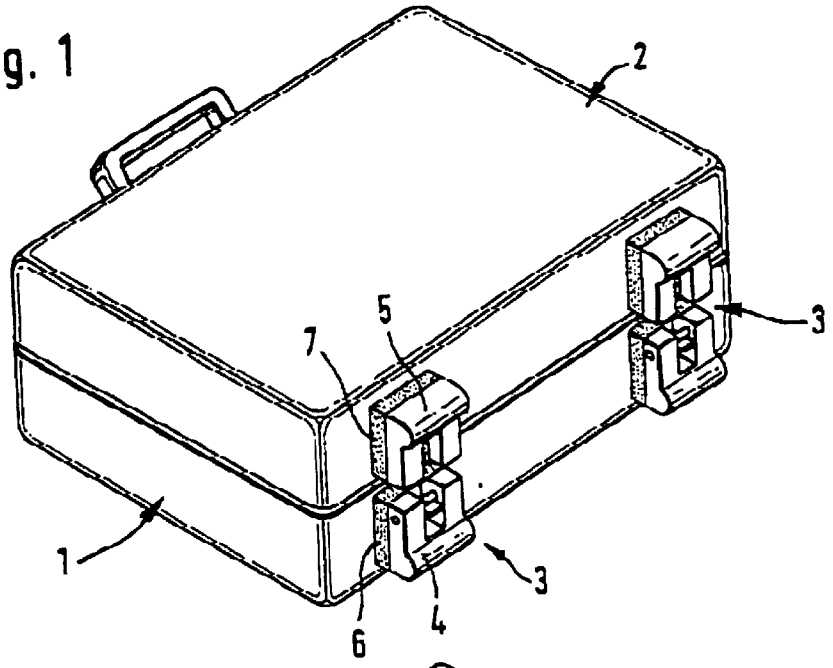
FIG. 1 is a perspective view of a carrying case viewing on to the side thereof bearing the support feet on which the carrying case will be generally put down.

Referring to the drawing, illustrated therein is a carrying case for an item of equipment to be accommodated therein in a protected condition, for example a notebook, the carrying case comprising a case bottom portion 1 for receiving the item to be protected and a case top portion 2 for enclosing the item of equipment. Besides a notebook, a printer may possibly be additionally accommodated in the carrying case.

It will be seen from FIG. 1 that the case bottom portion 1 and the case top portion 2 are each of a generally cuboidal shape having a main surface and four narrow sides, the case bottom portion thereby defining a space for receiving the item of equipment such as the notebook and the case top portion thus being adapted to enclose that item in a protected condition. A handle is provided on at least one of the top and bottom case portions at a narrow side thereof.

At the narrow sides of the case bottom and top portions 1 and 2 respectively, opposite to the side at which the above-mentioned handle is disposed, the case bottom portion 1 and the case top portion 2 are pivotably connected together by way of hinges which are shown here in the form of lift-off hinges, that is to say hinges of such a nature that one hinge portion can be lifted off or disengaged from the other co-operating hinge portion so that the case top portion 2 can be easily separated from the case bottom portion when the case top portion 2 has been pivoted through 180° with respect to the closed position of the case as shown in FIG. 1. Reference numeral 3 in FIG. 1 generally identifies one of the hinges.

Each hinge as indicated generally at reference 3 includes first and second hinge bodies 4 and 5, with the hinge body 4 being fixed to the appropriate narrow side of the case bottom portion 1 and the hinge body 5 being mounted to the corresponding narrow side of the case top portion 2 so that the hinge bodies 4 and 5 are in mutually adjacent relationship so as to co-operate with each other for relative pivotal movement of the case bottom portion 1 and the case top portion 2.

The configuration of each of the hinge bodies 4 and 5 will be discussed in greater detail hereinafter with reference to FIG. 2.

The hinge bodies 4 and 5 are in the form of shock-absorbing feet or legs for the carrying case. For that purpose, as shown in FIG. 2, foam or sponge rubber layers 6 and 7 are inserted between the actual hinge bodies 4 and 5 and the adjacent narrow sides of the case bottom portion 1 and the case top portion 2 respectively. In the event of an impact or shock force being applied to the hinge bodies 4 and 5, the layers 6 and 7 can be compressed for example to about half their volume in the rest condition. The layers 6 and 7 thus form shock-absorbing portions adapted to be compressible for example when the case is put down on the support feet afforded by the hinge bodies 4 and 5, under the weight of the case and possibly the contents thereof. The layers 6 and 7 can thus be about 10 mm in thickness in their rest condition, and can be compressed down to a thickness of around 5 mm.

Figure 2:
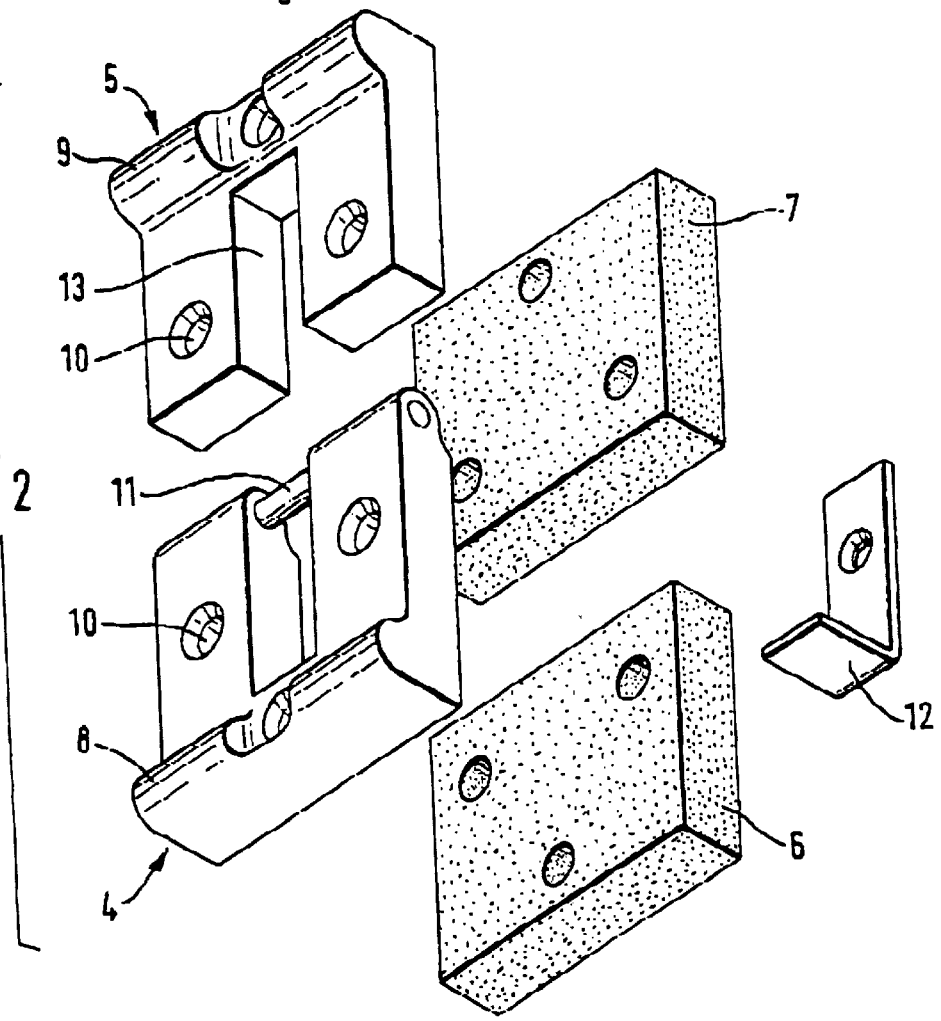
FIG. 2 is a perspective view of the hinges with shock-absorbing feet.

As will be seen also from FIG. 2, each hinge body 4 and 5 has a support bar portion 8 and 9 and a number of screw holes or bores 10 for securing the hinge bodies 4 and 5 together with the shock-absorbing portions or layers 6 and 7 to the case by means of screws passing therethrough. The support bar portions 8 and 9 provide feet adapted to support the carrying case. Mounted to the hinge body 4 is a hinge spindle 11 co-operable with a hinge hook 12 which is disposed in a space 13 in the hinge body 5, but which is shown separately therefrom, for the sake of simplicity of the drawing.

Various modifications may be made to the shock-absorbing feet of the carrying case according to the invention. For example the hinge bodies 4 and 5 could comprise foam rubber material with a firm strong skin or surface layer in order to guarantee both compliance and flexibility when subjected to shocks, jolts or other compressive forces and also freedom from damage in use. In that case the sponge rubber layers 6 and 7 can also be integrated into the respective hinge body.

It will be appreciated that the above-described embodiment of the invention has been set forth solely by way of example and illustration of the principles of the invention and that further modifications and alterations may be made therein without thereby departing from the spirit and scope of the invention.

What is claimed is:

1. A carrying case comprising a case bottom portion having walls which enclose a space for receiving an item of equipment to be protected, and which include a first lower wall arranged downmost when the carrying case is carried;

a case top portion having walls which enclose a space for enclosing the item of equipment, and which include a second lower wall arranged downmost when the carrying case is carried;

hinge means pivotably connecting said first lower wall of said case bottom portion and said second lower wall of said case top portion, and feet means arranged and adapted to support the carrying case standing on the feet means when deposited onto said first and second lower walls, wherein the hinge means include a first hinge and a second hinge, each having a first hinge body and a second hinge body which are fixed in mutually adjacent relationship to said first lower wall and said second lower wall of said case bottom portion and said case top portion respectively, and wherein said feet means include shock-absorbing portions adapted to be compressed when the case is put down on said feet means.

2. A case set forth in claim 1 wherein said shock-absorbing portions comprise foam rubbers layers.

3. A case set forth in claim 1 wherein each said shock-absorbing portion is disposed as an intermediate layer between a respective first or second lower wall and a respective hinge body.

4. A case set forth in claim 3 wherein the shock-absorbing portions are approximately 10 mm in thickness.

5. A case set forth in claim 1 wherein said hinge bodies are made up of foam rubber material having a skin on it.

6. A carrying case comprising a case bottom portion of a generally cuboidal shape and having a main surface and four narrow sides defining a space for receiving an item of equipment to be protected therein, a case top portion of generally cuboidal shape and having a main surface and four narrow sides for enclosing the item of equipment, handle means on at least one of the top and bottom portion at a respective narrow side thereof, hinge means pivotably connecting the case bottom portion and the case top portion at the narrow sides thereof in opposite relationship to the handle means, said hinge means including a first hinge and a second hinge, each of said first and second hinges comprising a first hinge body and a second hinge body which are fixed in mutually adjacent relationship to said narrow sides of the case bottom portion and said case top portion respectively, and hinge connection means adapted to couple said first and second hinge bodies together, and four shock-absorbing feet on which the carrying case is adapted to be supported, each shock-absorbing foot being arranged as a projecting portion of a respective hinge body and being adapted to be compressible under the weight applied thereto when the case is put down on said feet.

* * * * *